US012078191B2

(12) United States Patent
Wang et al.

(10) Patent No.: US 12,078,191 B2
(45) Date of Patent: Sep. 3, 2024

(54) ELECTRONIC WATER PUMP AND HOUSING ASSEMBLY THEREOF

(71) Applicant: GUANGDONG WELLING AUTO PARTS CO., LTD., Guangdong (CN)

(72) Inventors: Dong Wang, Guangdong (CN); Xiao Ge, Guangdong (CN); Huajiang Chen, Guangdong (CN)

(73) Assignee: GUANGDONG WELLING AUTO PARTS CO., LTD., Guangdong (CN)

( * ) Notice: Subject to any disclaimer, the term of this patent is extended or adjusted under 35 U.S.C. 154(b) by 757 days.

(21) Appl. No.: 17/119,173

(22) Filed: Dec. 11, 2020

(65) Prior Publication Data

US 2021/0131448 A1 May 6, 2021

Related U.S. Application Data

(63) Continuation of application No. PCT/CN2019/094988, filed on Jul. 8, 2019.

(30) Foreign Application Priority Data

Aug. 31, 2018 (CN) ..... 201811014637.0
Aug. 31, 2018 (CN) ..... 201821424766.2

(51) Int. Cl.
*F04D 29/60* (2006.01)
*F04D 13/06* (2006.01)
*F04D 29/40* (2006.01)

(52) U.S. Cl.
CPC ..... *F04D 29/605* (2013.01); *F04D 13/06* (2013.01); *F04D 29/406* (2013.01)

(58) Field of Classification Search
CPC .... F04D 29/605; F04D 29/406; F04D 29/426; F04D 29/026; F04D 13/06; F05D 2230/20
See application file for complete search history.

(56) References Cited

U.S. PATENT DOCUMENTS 9,568,012 B2 * 2/2017 Aso ..... H02K 1/278
2013/0213325 A1 * 8/2013 Kim ..... F01P 5/10 417/423.1

(Continued)

FOREIGN PATENT DOCUMENTS

CN 202381401 U 8/2012
CN 104061169 A * 9/2014

(Continued)

OTHER PUBLICATIONS

International Search Report dated Oct. 8, 2019 received in International Application No. PCT/CN2019/094988.

(Continued)

*Primary Examiner* — Bayan Salone
(74) *Attorney, Agent, or Firm* — Scully, Scott, Murphy & Presser, P.C.

(57) ABSTRACT

A method of providing a housing assembly and an electronic water pump, a housing assembly and an electronic water pump are provided. The housing assembly of the electronic water pump has a stator assembly, a rotary shaft, a shaft base, and an injection molded housing. The stator assembly is formed through one-piece injection molding. The housing assembly is formed by over-molding. The rotary shaft and the shaft base of the pump are embedded in the injection molded housing. The stator assembly is enclosed by the injection molded housing to provide self-sealing between the stator assembly and the injection molded housing.

10 Claims, 4 Drawing Sheets

(56) References Cited

U.S. PATENT DOCUMENTS

| | | | | |
|---|---|---|---|---|
| 2014/0271280 | A1* | 9/2014 | Ley | F04D 13/024 310/43 |
| 2015/0052935 | A1* | 2/2015 | Aso | F25B 41/00 29/598 |

FOREIGN PATENT DOCUMENTS

| | | | | | |
|---|---|---|---|---|---|
| CN | 105656221 | A | * | 6/2016 | |
| CN | 106655543 | A | | 5/2017 | |
| CN | 207004840 | U | | 2/2018 | |
| CN | 208749589 | U | | 4/2019 | |
| CN | 208749589 | U1 | | 4/2019 | |
| CN | 113969821 | A | * | 1/2022 | |
| EP | 3163087 | A1 | * | 5/2017 | B29C 45/14467 |
| JP | 2018050464 | A | * | 3/2018 | |
| WO | WO-2013114431 | A1 | * | 8/2013 | F04D 13/064 |

OTHER PUBLICATIONS

International Search Report dated Oct. 8, 2019 received in International Application No. PCT/CN2019/094988 together with an English language translation.

Supplementary European Search Report dated Jul. 22, 2021 received in European Patent Application No. EP 19853681.5.

Notice of Reasons for Refusal dated Mar. 8, 2022 received in Japanese Patent Application No. JP 2021-518843 together with an English language translation.

Office Action dated Jan. 30, 2023 received in European Patent Application No. EP 19853681.5.

First Office Action dated May 29, 2024 received in Chinese Patent Application No. CN 201811014637.0.

* cited by examiner

ELECTRONIC WATER PUMP AND HOUSING ASSEMBLY THEREOF

CROSS-REFERENCES TO RELATED APPLICATIONS

The present application is a continuation application of PCT International Application No. PCT/CN2019/094988, filed on Jul. 8, 2019, which claims the priority of Chinese Patent Application No. 201811014637.0, filed with the Chinese Patent Office on Aug. 31, 2018 and entitled "Electronic Water Pump and Housing Assembly Thereof", and the priority of Chinese Patent Application No. 201821424766.2, filed with the Chinese Patent Office on Aug. 31, 2018 and entitled "Electronic Water Pump and Housing assembly Thereof", the entire contents of which are herein incorporated by reference for all purposes. No new matter has been introduced.

FIELD

The present disclosure relates to the technical field of electronic water pumps, in particular to a housing assembly for an electronic water pump and an electronic water pump comprising the housing assembly.

BACKGROUND

In view of energy-saving as a general trend, most modern high-end automobiles and electric vehicles replace original mechanical water pumps with electronic cooling water pumps. Electronic water pumps have the advantages of accurate control and higher efficiency compared with the original mechanical water pumps. For a traditional electronic water pump, the stator of the traditional electronic water pump is arranged on the housing; the rotor and the impeller are provided at the water power part of the pump; and an isolation sleeve is provided between the rotor and the stator of the pump, to play a sealing role. Thus, the traditional electronic water pump has extra parts, the assembling of the pump is complicated and the overall cost of the pump is high.

A related technique discloses a motor structure of an electronic water pump. According to this motor structure, a stator assembly comprises a core shaft, an armature, a rear thrust pad, and a stator injection molded layer. The armature, the core shaft and the rear thrust pad are formed by one-piece injection molding; the stator injection molded layer has the functions of the motor housing, end cover and stator isolation sleeve; the BMC thermosetting molding plastic block is adopted in the stator injection molded layer. It has disadvantages as follows. 1) The stator injection molded layer adopts a BMC thermosetting molding plastic block, which has low strength and cannot meet the strength requirements of the motor housing; 2) the stator injection molded layer has a large volume and takes a long time for injection molding. It is easy to cause damage to the windings enclosed inside the stator injection molded layer; 3) if the stator injection molded layer uses high strength PPS material, it will increase the manufacturing cost.

SUMMARY

The present disclosure is directed to solve at least one of the above-mentioned technical problems.

To this end, it is an object of a first aspect of the present disclosure to provide a housing assembly for an electronic water pump.

It is an object of a second aspect of the present disclosure to provide an electronic water pump including the housing assembly described above.

In order to achieve the above objects, the technical solution of the present disclosure provides a housing assembly for an electronic water pump, wherein the housing assembly comprises a stator assembly and an injection molded housing, the stator assembly is formed by one-piece injection molding, the housing assembly is formed by over-molding, and the stator assembly is enclosed inside the injection molded housing to form a self-seal.

In order to achieve the above objects, the technical solution of the present disclosure also provides a housing assembly for an electronic water pump. The housing assembly comprises a stator assembly, a rotatory shaft, a shaft base and an injection molded housing, wherein the stator assembly is formed by one-piece injection molding, the housing assembly is formed by over-molding, the rotatory shaft and the shaft base are both embedded in the injection molded housing, and the stator assembly is enclosed inside the injection molded housing to form a self-seal.

According to the housing assembly for the electronic water pump provided by any of the above technical solutions of the present disclosure, the stator assembly is formed by one-piece injection molding, the stator assembly and the injection molded housing (the housing of the motor) are subjected to over-molding, and the self-sealing effect with the rotor is realized. The isolation sleeve between the air gap of the stator and the rotor is omitted, the material cost of the housing is reduced, the assembly process of the electronic water pump is simplified, and the rigidity of the stator assembly is improved. It is conducive to the improvement of the noise of the electronic water pump and the reliability of the operation of the electronic water pump. Therefore, the housing assembly for the electronic water pump of the above solution has obvious advantages in installation technology, cost and performance.

Secondly, the stator assembly is formed by one-piece injection molding firstly, and then the housing assembly is formed by over-molding, so that the stator injection molded body of the injection molded stator assembly can adopt injection molding material which is lower in cost than the injection molded housing. Compared with the related art that the stator injection molded layer is used as the motor housing, the solution saves material cost. Thirdly, the stator injection molded body and the injection molded housing are respectively injection molded, so that the size of the stator injection molded body is small, the injection molding time is short, the winding and other parts in the stator injection molded body cannot be damaged when the stator injection molded body is injection molded, and the performance reliability of the electronic water pump is ensured.

In addition, the housing assembly for the electronic water pump provided in the above-mentioned technical solution of the present disclosure can also have the following additional technical features.

In the above technical solution, optionally, the stator assembly comprises a contact pin, a winding, an insulation frame, a stator core and a stator injection molded body, wherein the insulation frame encloses the stator core, the winding is wound on a tooth part of the insulation frame, the contact pin is fixed in a groove of the insulation frame, and the contact pin, the winding, the insulation frame and the stator core are enclosed and fastened by the stator injection molded body.

The whole part of the stator assembly is enclosed and fastened through the stator injection molded body, so that the stator assembly is formed by one-piece injection molding into a whole.

In the above technical solution, optionally, the stator assembly comprises a stator injection molded body, wherein the stator injection molded body is a thermosetting material, and the solid deformation temperature of the thermosetting material is not lower than an injection temperature of the injection molded housing.

The stator injection molded body adopts thermosetting materials, optionally BMC thermosetting materials, and the material cost is low; the solid deformation temperature of the thermosetting material is not lower than an injection temperature of the injection molded housing in order to avoid the risk of melting the stator injection molded body formed by one-piece injection molding during the second injection of the housing assembly.

In the above technical solution, optionally, the stator assembly comprises a stator injection molded body, wherein the stator injection molded body is a thermosetting material, and the injection molded housing is a PPS material.

The stator injection molded body adopts a low-cost thermosetting material, optionally a BMC thermosetting material, and the injection molded housing adopts a PPS material with high strength so that the strength of the injection molded housing is ensured, and the material cost is saved.

In the above technical solution, optionally, the stator assembly comprises a stator injection molded body, and a material strength of the injection molded housing is greater than a material strength of the stator injection molded body.

According to the solution, the stator assembly is formed by one-piece injection molding firstly, and then the housing assembly is formed by over-molding so that the stator injection molded body of the injection molded stator assembly and the injection molded housing of the injection molded housing assembly can adopt different injection plastics. The injection molded housing has high required strength so the injection molding materials with high cost can be adopted. The stator injection molded body has low required strength, so the injection molding materials with low cost can be adopted. Compared with the related art that the stator injection molded layer is used as the motor housing, the solution ensures the strength of the injection molded housing and saves material cost.

The technical solution of the second aspect of the present disclosure provides an electronic water pump which comprises a water power part, a brushless motor part and a control part, wherein the water power part comprises a pump housing and an impeller; the brushless motor part comprises a rotor and a housing assembly according to any of the above technical solutions; the control part comprises a control panel and a rear end cover; the brushless motor part is arranged between the water power part and the control part.

The electronic water pump provided by the technical solution according to the present disclosure has the beneficial effect of the housing assembly for any of the above technical solutions because the electronic water pump comprises the housing assembly for any of the above technical solutions.

In the above technical solution, optionally, the impeller and the rotor are formed by one-piece injection molding into an impeller rotor assembly.

The impeller of the water power part and the rotor of the brushless motor part are formed by one-piece injection molding and are respectively arranged inside the pump housing and the housing so that the impeller rotor assembly is convenient to manufacture and low in cost.

In the above technical solution, optionally, the impeller comprises an impeller main body and a blade, the rotor comprises a rotor core, a magnetic steel and a shaft sleeve, the rotor core is provided with a magnetic steel groove, the magnetic steel is installed in the magnetic steel groove, the rotor core and the magnetic steel are packaged inside the impeller main body through plastic molding to form an impeller rotor assembly 1, the shaft sleeve is subjected to over-molding into the impeller rotor assembly 1 to form an impeller rotor assembly 2, and the impeller rotor assembly 2 is connected with the blade to form the impeller rotor assembly.

According to the above solution, the impeller rotor assembly comprises an impeller and a rotor. The impeller comprises an impeller main body and a blade; the rotor comprises a core, a magnetic steel and a shaft sleeve, wherein the impeller rotor assembly is formed by a two-step injection molding process, the impeller main body is formed by the first step injection molding, and the shaft sleeve is formed by the second step injection molding, so that the impeller main body can be made of materials cheaper than the shaft sleeve and compared with the impeller rotor assembly in which the shaft sleeve and the impeller main body are formed by one-piece injection molding, the manufacturing cost is saved. Secondly, the core and the magnetic steel are packaged in the impeller main body through plastic molding, and the bonding is firm; the shaft sleeve is small in size and light in weight so that the torque for driving the shaft sleeve to rotate is small when the impeller rotor assembly rotates, and the shaft sleeve is not easy to slip. Thirdly, the impeller main body is large in size and the shaft sleeve is small in size so that the speed is high when the shaft sleeve is injected and the influence on the impeller rotor assembly 1 is avoided, that is, the impeller main body formed by the first injection molding is not melted when the shaft sleeve is formed by over-molding. Therefore, the risk of the displacement of the core and the magnetic steel is well avoided.

In the above technical solution, optionally, the blade is an injection molded body, and the impeller rotor assembly 2 and the blade are integrally welded through ultrasonic waves.

The impeller is formed by an ultrasonic wave welding process, and the blade and the impeller rotor assembly 2 are integrally welded through ultrasonic waves; the injection mold for integral injection molding the impeller is complex in structure and high in maintenance cost, so that the impeller is divided into the impeller main body and the blade to be respectively injection molded and then formed by ultrasonic wave welding. The structure of the injection mold is simple, and the maintenance cost of the injection mold is greatly reduced.

In the above technical solution, optionally, a wear resistance of the shaft sleeve is better than a wear resistance of the impeller main body.

The impeller rotor assembly is formed by a two-step injection molding process, the impeller main body is formed by the first step injection molding, and the shaft sleeve is formed by the second step injection molding, so that the injection molding materials used in the respective injection molding of the impeller main body and the shaft sleeve can be different. The material of the injection molded impeller main body is required to be high strength and acid and alkali resistance, and the material of the injection molded shaft sleeve is required to be wear-resistant, high strength, and acid and alkali resistance. The material cost for the injection molded shaft sleeve is high, and the material cost for the injection molded impeller main body is low, so that compared with the impeller rotor assembly in which the shaft sleeve and the impeller main body are formed by one-piece injection molding, the manufacturing cost is saved.

In any of the above technical solutions, optionally, a first sealing ring is arranged between the front end of the injection molded housing of the housing assembly and the pump housing to form a closed water power cavity; a second sealing ring is arranged between the rear end of the injection molded housing of the housing assembly and the rear end cover to form a closed electric control chamber.

The control panel of the control part is arranged in the electric control chamber formed by the housing and the rear end cover, and the brushless motor part is arranged between the water power part and the control part; the stator assembly for the brushless motor part is formed by one-piece injection molding and is subjected to over-molding with the housing; sealing rings are respectively arranged between the housing of the brushless motor part and the pump housing, and between the housing of the brushless motor part and the rear end cover, so that the electronic water pump is sealed. According to another aspect of the disclosure, a method of providing a housing assembly for an electronic water pump is provided. The method includes providing a stator assembly through one-piece injection molding; and providing a housing through injection molding. The housing is over-molded on the stator assembly to enclose the stator assembly, such that self-sealing is provided between the stator assembly and the housing. According yet another aspect of the disclosure, a method of providing an electronic water pump is provided. The method includes providing a water power part; providing a brushless motor part; and providing a control part. The water power part comprises a pump housing and an impeller. The brushless motor part comprises a rotor and a housing assembly. The control part comprises a control panel and a rear end cover. The brushless motor part is arranged between the water power part and the control part. The housing assembly is provided by providing a stator assembly through one-piece injection molding and providing a housing through injection molding, wherein the housing is over-molded on the stator assembly to enclose the stator assembly, such that self-sealing is provided between the stator assembly and the housing.

In any of the above technical solutions, optionally, the water power part and the brushless motor part are fixedly connected through screws, and the brushless motor part and the control part are fixedly connected through screws, so that the assembly is convenient and the connection is firm.

Additional aspects and advantages of the present disclosure will be apparent from the description which follows, or may be learned by practice of the present disclosure.

BRIEF DESCRIPTION OF THE DRAWINGS

The foregoing and/or additional aspects and advantages of the present disclosure will be apparent from and elucidated in combination with the embodiments described hereinafter with reference to the accompanying drawings, in which.

DESCRIPTION OF REFERENCE NUMERALS

1 housing assembly, 11 stator assembly, 111 contact pin, 112 winding, 113 stator core, 114 stator injection molded body, 115 insulation frame, 12 rotatory shaft, 13 shaft base, 14 injection molded housing, 2 pump housing, 3 impeller rotor assembly, 31 shaft sleeve, 32 magnetic steel, 33 rotor core, 34 impeller main body, 35 blade, 4 first sealing ring, 5 second sealing ring, 6 control panel, and 7 rear end cover.

DETAILED DESCRIPTION OF THE EMBODIMENTS

In order that the above objects, features and advantages of the present disclosure may be more clearly understood, the present disclosure will be described in further detail with reference to the accompanying drawings and detailed description. It should be noted that the embodiments and features in the embodiments of the present disclosure may be combined with one another without conflicts.

In the following description, numerous specific details are set forth in order to provide a thorough understanding of the present disclosure, but the present disclosure may be practiced otherwise than as described herein, and therefore, the scope of the present disclosure is not limited to the specific embodiments disclosed below.

An electronic water pump and housing assembly thereof according to some embodiments of the present disclosure will now be described with reference to FIGS. 1 to 4.

Figure 2:
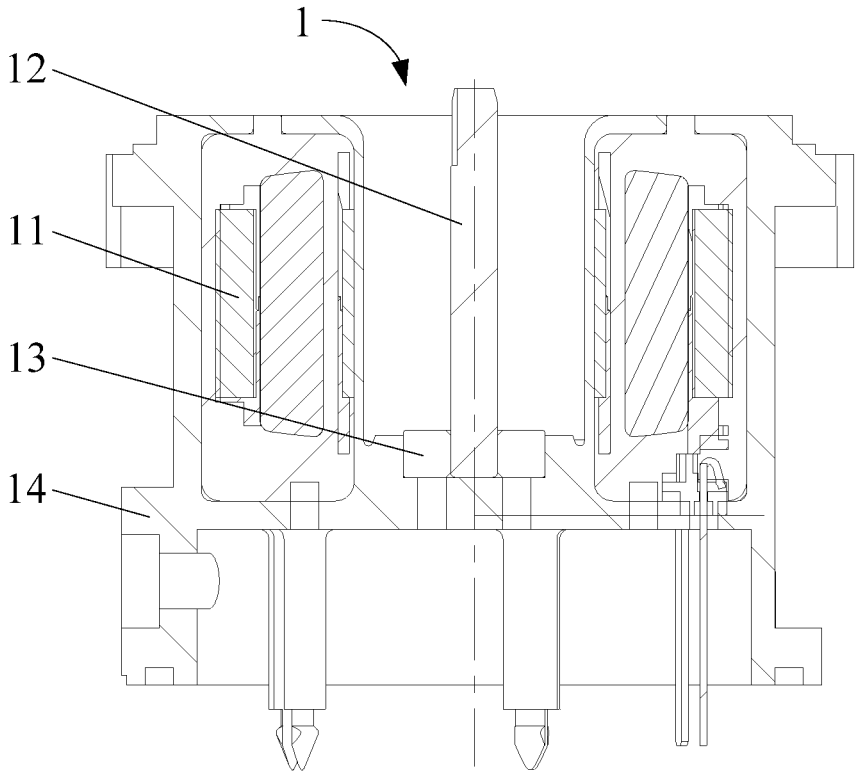
FIG. 2 is a schematic sectional structural view of a housing assembly according to one embodiment of the present disclosure.
Figure 3:
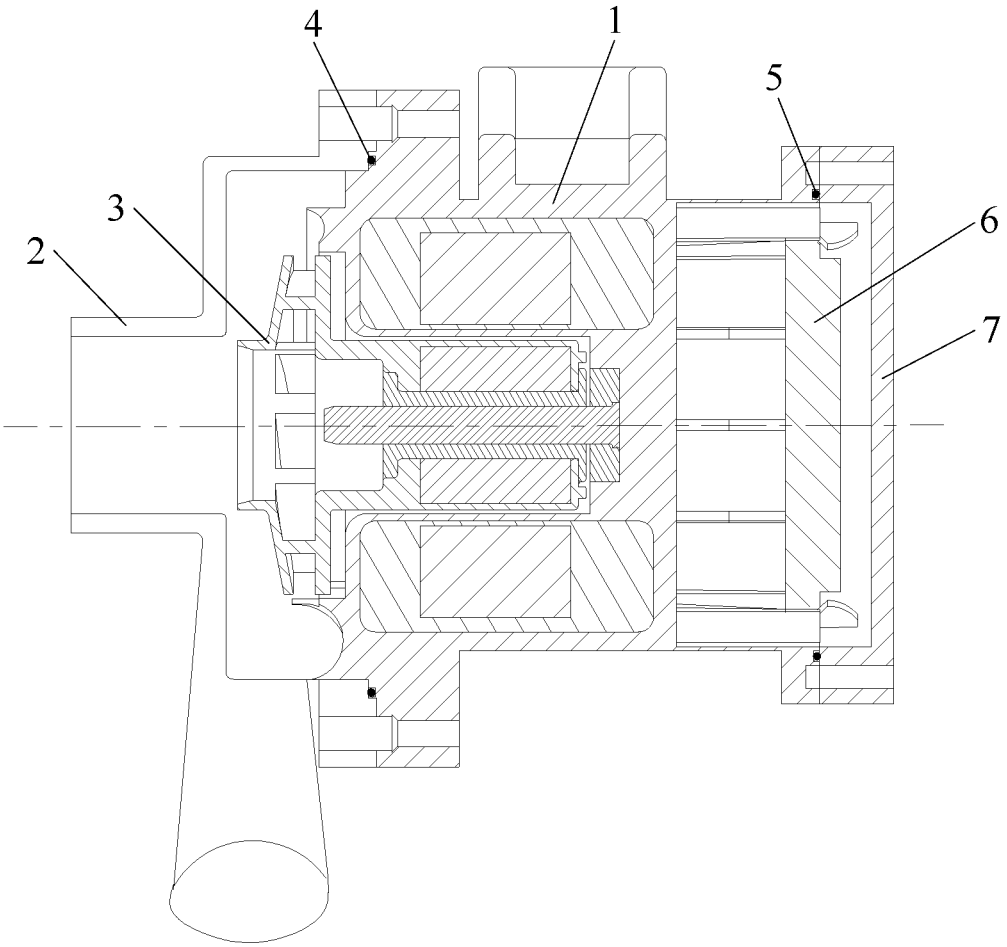
FIG. 3 is a schematic sectional structural view of an electronic water pump according to one embodiment of the present disclosure.

As shown in FIGS. 2 and 3, a housing assembly 1 of an electronic water pump according to some embodiments of the present disclosure comprises a stator assembly 11, a rotatory shaft 12, a shaft base 13, and housing 14 that can be manufactured by injection molding. The stator assembly 11 is formed by one-piece injection molding. The housing assembly 1 is formed by over-molding. The rotary shaft 12 is in interference fit with the shaft base 13. The rotary shaft 12 and the shaft base 13 are embedded in the injection molded housing 14. The stator assembly 11 is enclosed by the injection molded housing 14 and becomes self-sealed.

According to the housing assembly 1 of the electronic water pump provided by the above embodiment of the present disclosure, the stator assembly 11 is formed integrally by one-piece injection molding, and the stator assembly 11 and the housing 14 are subsequently subjected to over-molding, thereby implementing self-sealing with the rotor. Thus, the isolation sleeve between the air gap of the stator and the rotor, which is required by the traditional electronic water pump, is omitted, the material cost of the housing is reduced, the assembly process of the electronic water pump is simplified, and the rigidity of the stator assembly 11 is improved. In addition, the noise of the electronic water pump can be reduced and the operational reliability of the electronic water pump can be improved. Therefore, the housing assembly 1 of the electronic water pump of the above embodiment has salient advantages in installation, cost and performance.

Secondly, by the process of first integrally injection-molding the stator assembly 11 and subsequently injection-molding the housing assembly 1, the stator injection molded body 114 of the injection molded stator assembly 11 and the injection molded housing 14 of the injection molded housing assembly 1 can adopt different injection plastics. The injection molded housing 14 requires higher strength, so injection plastics with higher cost can be adopted. The stator injection molded body 114 requires lower strength, so injection plastics with lower cost can be adopted. Compared with a stator injection molded layer serving as a motor housing in the related art, the electronic water pump according to this embodiment not only ensures the strength of the injection molded housing 14, but also reduces the material cost. Thirdly, the stator injection molded body 114 and the injection molded housing 14 are injection molded respectively, so that the size of the stator injection molded body 114 can be small, the injection molding time can be shortened, and the injection molding of the stator injection molded body 114 will not cause damage to the winding 112 and other components inside the stator injection molded body 114, thereby ensuring the performance reliability of the electronic water pump.

Figure 1:
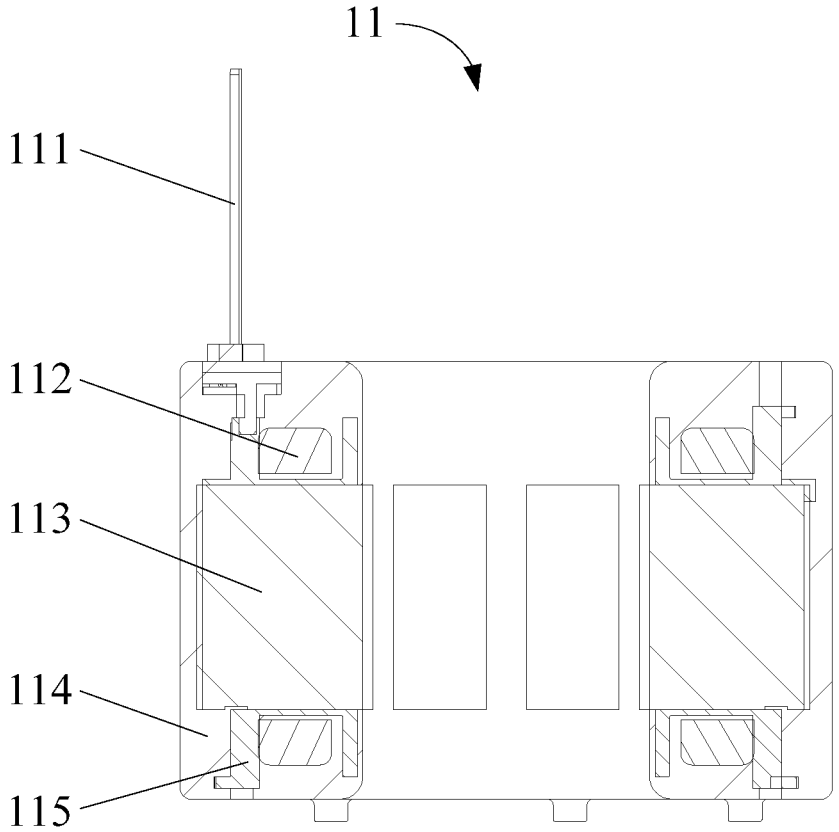
FIG. 1 is a schematic sectional structural view of a stator assembly according to one embodiment of the present disclosure.

In one embodiment of the present disclosure, as shown in FIG. 1, the stator assembly 11 includes a contact pin 111, the winding 112, an insulation frame 115, a stator core 113 and the stator injection molded body 114. The insulation frame 115 encloses the stator core 113, the winding 112 is wound around teeth of the insulation frame 115, and the contact pin 111 is fixed in a groove of the insulation frame 115. The contact pin 111, the winding 112, the insulation frame 115 and the stator core 113 are enclosed and fastened or integrated by the stator injection molded body 114. The whole part of the stator assembly 11 is enclosed and fastened by the stator injection molded body 114, so that the stator assembly 11 is integrally formed by one-piece injection molding in its entirety.

Optionally, the stator assembly 11 includes the stator injection molded body 114 that is made of a thermosetting material having a solid deformation temperature not lower than an injection temperature of the injection molded housing 14.

The stator injection molded body 114 adopts thermosetting materials, optionally BMC thermosetting materials, and the material cost is low; the solid deformation temperature of the thermosetting material is not lower than an injection temperature of the injection molded housing 14 in order to avoid the risk of melting the stator injection molded body 114 formed by one-piece injection molding during the second or subsequent injection of the housing assembly 1.

Optionally, the stator assembly 11 includes the stator injection molded body 114 that is made of a thermosetting material and the injection molded housing 14 is a PPS material.

The stator injection molded body 114 adopts a low-cost thermosetting material, optionally a BMC thermosetting material, and the injection molded housing 14 adopts a PPS material with high strength, so that the strength of the injection molded housing 14 is ensured, and the material cost is saved.

As shown in FIG. 3, an embodiment of the second aspect of the present disclosure provides an electronic water pump which comprises a water power part, a brushless motor part and a control part. The water power part comprises a pump housing 2 and an impeller. The brushless motor part comprises a rotor and the housing assembly 1 according to any previous embodiment. The control part comprises a control panel 6 and a rear end cover 7. The brushless motor part is arranged between the water power part and the control part.

The electronic water pump provided by the foregoing embodiment of the present disclosure includes the housing assembly 1 of any of the foregoing embodiments, and therefore shares the beneficial of the housing assembly 1 of any of the foregoing embodiments, and will not be repeated here.

Figure 4:
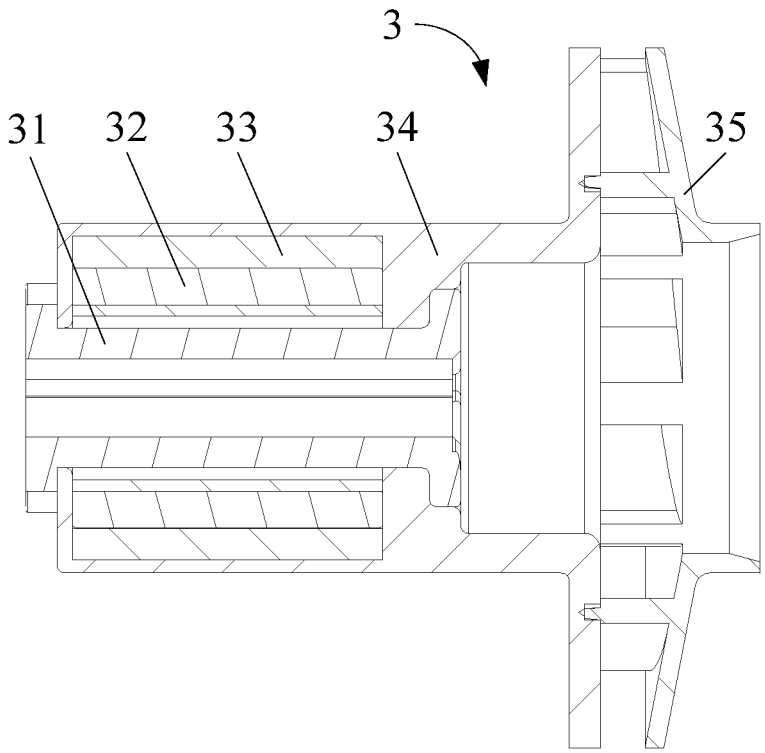
FIG. 4 is a schematic sectional structural view of an impeller rotor assembly according to one embodiment of the present disclosure.

Optionally, as shown in FIGS. 3 and 4, the impeller and rotor are formed integrally by one-piece injection molding into an impeller rotor assembly 3.

The impeller of the water power part and the rotor of the brushless motor part are formed by one-piece injection molding and are respectively arranged inside the pump housing 2 and the housing assembly 1, so that it is convenient to manufacture the impeller rotor assembly 3 and the manufacture cost can be reduced.

In one embodiment of the present disclosure, as shown in FIG. 4, the impeller comprises an impeller main body 34 and a blade 35; and the rotor comprises a rotor core 33, a magnetic steel 32 and a shaft sleeve 31. The rotor core 33 is provided with a groove, in which the magnetic steel 32 is mounted. The rotor core 33 and the magnetic steel 32 are packaged inside the impeller main body 34 through plastic molding, to form a precursor 3' of the impeller rotor assembly 3. The shaft sleeve 31 is subsequently over-molded into the precursor 3' to form a further precursor 3" of the impeller rotor assembly 3. Afterwards, the precursor 3" is connected to the blade 35 to form the impeller rotor assembly 3.

According to the embodiment, the impeller rotor assembly 3 comprises the impeller and the rotor. The impeller comprises the impeller main body 34 and the blade 35; the rotor comprises the rotor core 33, the magnetic steel 32 and the shaft sleeve 31. The impeller rotor assembly 3 is formed by a two-step injection molding process. The impeller main body 34 is formed in the first step by injection molding, and the shaft sleeve 31 is formed in the second step by injection molding, so that injection molding materials used when the impeller main body 34 and the shaft sleeve 31 are respectively injection molded can be different. The material of the injection molded impeller main body 34 is required to be of high strength and acid and alkali resistance, and the material of the injection molded shaft sleeve 31 is required to be of wear-resistant, high strength, and acid and alkali resistance. The material cost for the injection molded shaft sleeve 31 is high, and the material cost for the injection molded impeller main body 34 is low, so that compared with the impeller rotor assembly 3 in which the shaft sleeve 31 and the impeller main body 34 are formed integrally by one-piece injection molding, the manufacturing cost is saved. Secondly, the core and the magnetic steel 32 are packaged in the impeller main body 34 through plastic molding, and the bonding is thus firm; the shaft sleeve 31 is small in size and light in weight so that the torque for driving the shaft sleeve 31 to rotate is small when the impeller rotor assembly 3 rotates, and the shaft sleeve 31 is not easy to slip. Thirdly, the impeller main body 34 is large in size and the shaft sleeve 31 is small in size so that the speed is high when the shaft sleeve 31 is injected and the influence on the precursor 3' of the impeller rotor assembly 3 is avoided, that is, the impeller main body formed by the first injection molding is not melted when the shaft sleeve 31 is formed by over-molding. Therefore, the risk of the displacement of the core and the magnetic steel 32 is well avoided.

Further, as shown in FIG. 4, the blade 35 is an injection molded body, and the precursor 3" of the impeller rotor assembly 3 and the blade 35 are integrally welded by ultrasonic waves to form the impeller rotor assembly 3.

The impeller is formed by an ultrasonic welding process, and the blade 35 and the precursor 3" of the impeller rotor assembly 3 are integrally welded through ultrasonic waves; the injection mold for integral injection molding the impeller is complex in structure and high in maintenance cost, so that the impeller is divided into the impeller main body 34 and the blade 35 for injection molding respectively, the blade 35 is provided with a welding line, the impeller main body 34 is provided with a welding groove, the impeller is formed by ultrasonic wave welding, the structure of the injection mold is simple, and the maintenance cost of the injection mold is greatly reduced.

For example, a first sealing ring 4 is arranged between the front end of the injection molded housing 14 of the housing assembly 1 and the pump housing 2 to form a closed water power cavity; a second sealing ring 5 is arranged between the rear end of the injection molded housing 14 of the housing assembly 1 and the rear end cover 7 to form a closed electric control chamber.

The control panel 6 of the control part is arranged in the electric control chamber formed by the housing and the rear end cover 7. The motor part achieves current commutation by arranging the control panel 6 so as to ensure that the motor rotates continuously; the brushless motor part is arranged between the water power part and the control part; the stator assembly 11 of the brushless motor part is formed by one-piece injection molding and is subjected to over-molding with the housing; sealing rings are respectively arranged between the housing of the brushless motor part and the pump housing 2, and between the housing of the brushless motor part and the rear end cover 7, so that the electronic water pump is sealed.

Optionally, the water power part and the brushless motor part are fixedly connected through screws, and the brushless motor part and the control part are fixedly connected through screws so that the assembly is convenient and the connection is firm.

In an exemplary embodiment, as shown in FIG. 3, the electronic water pump comprises a water power part, a brushless motor part and a control part; the impeller of the water power part and the rotor of the brushless motor part are formed by one-piece injection molding, and are respectively arranged inside the pump housing 2 and the housing; the control panel 6 of the control part is arranged in the electric control chamber formed by the housing and the rear end cover 7, and the brushless motor part is arranged between the water power part and the control part; the stator assembly 11 of the brushless motor part is formed by one-piece injection molding and is subjected to over-molding with the housing; sealing rings are respectively arranged between the housing of the brushless motor part and the pump housing 2, and between the housing of the brushless motor part and the rear end cover 7, so that the electronic water pump is sealed; according to the solution, the integral injection molding technology of the stator and the housing is utilized, so that the material cost of the housing of the traditional electronic water pump is saved, the isolation sleeve in the middle of the air gap of the stator and the rotor is omitted, and the installation process of the electronic water pump is simplified; in addition, the improvement of the rigidity of the stator is also beneficial to the improvement of the noise of the electronic water pump, and therefore, the solution has remarkable advantages in installation process, cost and performance.

For example, the electronic water pump is an electronic water pump for automobiles.

In the description of the present disclosure, it is to be understood that the terms "inner", "outer", and the like indicate orientations or positional relationships based on the orientations or positional relationships shown in the drawings for purposes of describing the present disclosure and simplifying the description only and are not intended to indicate or imply that the referenced device or unit must have a particular orientation, be constructed and operated in a particular orientation, and therefore, are not to be construed as limiting the present disclosure.

In the description of this application, unless otherwise clearly specified and limited, the terms "connected with", "connected to", "fixed", etc. should be understood in a broad sense. For example, "connected to" can be a fixed connection or a detachable connection, or integrally connected, or electrically connected; it can be directly connected or indirectly connected through an intermediate medium. The specific meaning of the above terms in this application will be understood by those of ordinary skills in the art, as the case may be.

In the illustration of the present description, the description of the terms "one embodiment", "some embodiments", "specific embodiments", etc. means that the specific features, structures, materials or characteristics described in conjunction with the embodiments or examples are included in this application in at least one embodiment or example. In this description, schematic representations of the above terms do not necessarily refer to the same embodiment or example. Furthermore, the particular features, structures, materials, or characteristics described may be combined in any suitable manner in any one or more embodiments or examples.

The foregoing is only a preferred embodiment of the present disclosure and is not intended to limit the application, as various modifications and changes therein will occur to those skilled in the art. Any modifications, equivalents, improvements, etc. that come within the spirit and principles of this application are intended to be included within the scope of this application.

What is claimed is:

1. A method of providing an electronic water pump, comprising:

providing a water power part;

providing a brushless motor part; and providing a control part, wherein:

the water power part comprises a pump housing and an impeller;

the brushless motor part comprises a rotor and a housing assembly;

the control part comprises a control panel and a rear end cover; and the brushless motor part is arranged between the water power part and the control part, wherein the housing assembly is provided by:

providing a stator assembly through one-piece injection molding; and providing a housing through injection molding, wherein the housing is over-molded on the stator assembly to enclose the stator assembly, such that self-sealing is provided between the stator assembly and the housing, wherein:

the impeller comprises an impeller main body and a blade;

the rotor comprises a rotor core, a magnetic steel and a shaft sleeve; and the rotor core is provided with a magnetic steel groove and the magnetic steel is installed in the magnetic steel groove, and wherein the method further comprises:

packing the rotor core and the magnetic steel inside the impeller main body through plastic molding to form a first precursor of an impeller rotor assembly;

over-molding the shaft sleeve into the first precursor to form a second precursor of the impeller rotor assembly; and connecting the second precursor to the blade to form the impeller rotor assembly.

2. The method of claim 1, wherein:

the blade comprises an injection molded body; and the second precursor of the impeller rotor assembly and the blade are integrally welded through ultrasonic waves.

3. The method of claim 1, wherein the shaft sleeve has a first wear resistance and the impeller main body has a second wear resistance, the first wear resistance being greater than the second wear resistance.

4. The method of claim 3, further comprising:

providing a first sealing ring between a front end of the housing of the housing assembly and a housing of the pump to form a closed water power cavity; and providing a second sealing ring between a rear end of the housing of the housing assembly and the rear end cover to form a closed electric control chamber.

5. The method of claim 3, further comprising:

fixedly connecting the water power part to the brushless motor part by screws; and fixedly connecting the brushless motor part to the control part by screws.

6. An electronic water pump comprising:

a water power part;

a brushless motor part; and a control part, wherein:

the water power part comprises a pump housing and an impeller;

the brushless motor part comprises a rotor and a housing assembly;

the control part comprises a control panel and a rear end cover; and the brushless motor part is arranged between the water power part and the control part, and wherein the housing assembly comprises:

a stator assembly formed through one-piece injection molding;

a housing formed through injection molding;

wherein the housing is over-molded on the stator assembly to enclose the stator assembly, such that self-sealing is provided between the stator assembly and the housing, wherein:

the impeller comprises an impeller main body and a blade;

the rotor comprises a rotor core, a magnetic steel and a shaft sleeve;

the rotor core is provided with a magnetic steel groove and the magnetic steel is installed in the magnetic steel groove;

the rotor core and the magnetic steel are packed inside the impeller main body through plastic molding as a first unit of an impeller rotor assembly;

the shaft sleeve is over-molded into the first unit to form a second unit of the impeller rotor assembly; and the blade is connected to the second unit to form the impeller rotor assembly.

7. The electronic water pump of claim 6, wherein:

the blade comprises an injection molded body; and the second unit and the blade are integrally welded through ultrasonic waves.

8. The electronic water pump of claim 6, wherein the shaft sleeve has a first wear resistance and the impeller main body has a second wear resistance, the first wear resistance being greater than the second wear resistance.

9. The electronic water pump of claim 8, further comprising:

a first sealing ring provided between a front end of the housing of the housing assembly and a housing of the pump to form a closed water power cavity; and a second sealing ring provided between a rear end of the housing of the housing assembly and the rear end cover to form a closed electric control chamber.

10. The electronic water pump of claim 8, further comprising:

screws fixedly connecting the water power part to the brushless motor part; and screws fixedly connecting the brushless motor part to the control part.

* * * * *